US005137207A

United States Patent [19]

McAdam

[11] Patent Number: 5,137,207

[45] Date of Patent: Aug. 11, 1992

[54] FLORAL CONTAINER WITH MULTIPLE DECORATIVE PANELS AND METHOD OF FORMING SAME

[76] Inventor: Christine A. McAdam, 350 34th St., Hermosa Beach, Calif. 90254

[21] Appl. No.: 692,274

[22] Filed: Apr. 26, 1991

[51] Int. Cl.[5] ..... B65D 1/40

[52] U.S. Cl. ..... 229/8; 229/922; 206/455

[58] Field of Search ..... 229/8, 922; 40/539, 40/610; 206/455

[56] References Cited

U.S. PATENT DOCUMENTS

| | | | |
|---|---|---|---|
| 1,121,259 | 12/1914 | Klin | 229/1.5 B |
| 1,269,169 | 6/1918 | Farley, Jr. . | |
| 1,656,620 | 1/1928 | Cossenas | 40/539 |
| 1,684,244 | 9/1928 | Richardson . | |
| 1,800,534 | 4/1931 | Jannings | 229/1.5 B |
| 1,881,375 | 10/1932 | Ristow | 229/4.5 |
| 1,931,213 | 2/1933 | Wheeler | 229/1.5 B |
| 2,325,281 | 7/1943 | Schleicher | 229/8 |
| 2,396,010 | 5/1944 | Isenberg . | |
| 2,794,545 | 6/1957 | Olson | 229/1.5 B |
| 3,007,377 | 11/1961 | Muller | 229/1.5 B |
| 3,189,253 | 6/1965 | Mojonnier | 206/610 |
| 3,224,660 | 12/1965 | Willis et al. . | |
| 3,684,155 | 8/1972 | Smith | 220/418 |
| 3,856,064 | 12/1974 | Swalleri | 229/117.01 |
| 3,902,651 | 9/1975 | Marshall | 229/3.5 R |
| 4,084,015 | 4/1978 | Patterson . | |
| 4,179,060 | 12/1979 | Meyers . | |
| 4,201,331 | 5/1980 | Austin . | |
| 4,418,497 | 12/1983 | Mastriano . | |
| 4,784,314 | 11/1988 | Penick . | |
| 4,840,275 | 6/1989 | Faiola et al. . | |
| 4,887,709 | 12/1989 | Shimamine . | |
| 4,888,175 | 12/1989 | Burton, Jr. et al. | 206/423 |
| 4,896,819 | 1/1990 | Grossman . | |
| 4,917,240 | 4/1990 | Roberts et al. . | |
| 4,948,266 | 8/1990 | Bencic | 220/404 |
| 5,014,872 | 5/1991 | Robbins, III | 220/403 |

FOREIGN PATENT DOCUMENTS

| | | | |
|---|---|---|---|
| 628618 | 11/1961 | Italy | 229/8 |
| 0297571 | 9/1928 | United Kingdom | 206/418 |

OTHER PUBLICATIONS

Six Photographs of Basket Box, Blossom Babies-In-A-Basket, John Grossman, Inc., Sausalito, Calif. 94965.

*Primary Examiner*—Stephen Marcus
*Assistant Examiner*—Christopher McDonald
*Attorney, Agent, or Firm*—Christie, Parker & Hale

[57] ABSTRACT

A container, such as for a floral arrangement, is formed from a unitary die-cut sheet of material. The container has a core, defined by walls and a bottom and having an open top, and decorative panels extend from the walls. The sheet contains connected wall sections and decorative panel sections, the wall sections forming the walls and the panel sections folding together in pairs to form the decorative panels. There are at least two decorative panel sections between two adjacent wall sections, such that when the panel sections are folded together, the wall sections will be adjacent in the container core, and the panel formed by the panel sections will extend outward from the core. The bottom is formed by tabs on the wall sections which fold inward. In some embodiments, the container is collapsible to a substantially planar form. A method of folding the sheet to form the container includes the steps of folding together adjacent panel sections to form the decorative panels, folding the walls into the shape of the core, connecting each end of the unitary sheet, and folding the tabs inward to form the bottom of the core. The container is made watertight by treating the sheet, using a plastic sheet, or using a watertight liner attached to the inside of the container core or an insertable structure.

29 Claims, 11 Drawing Sheets

Fig. 5
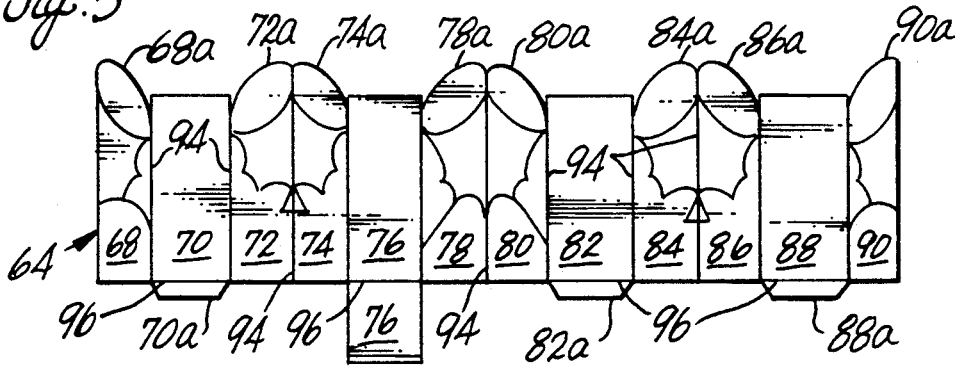
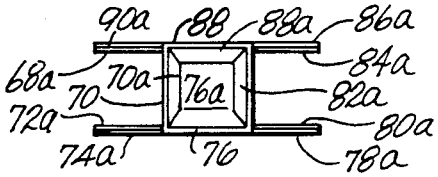
Fig. 6
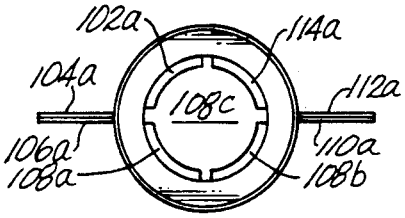
Fig. 8
Fig. 7
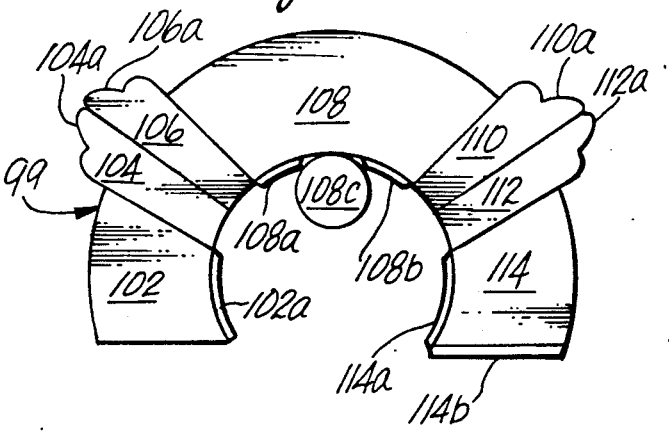
Fig. 9
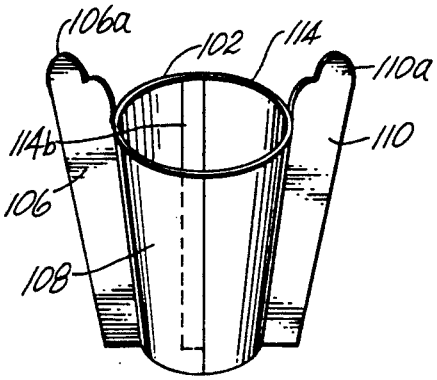

FLORAL CONTAINER WITH MULTIPLE DECORATIVE PANELS AND METHOD OF FORMING SAME

FIELD OF THE INVENTION

The present invention relates to a container such as for flower arrangements and, more specifically, to a floral container, with multiple decorative panels, formed from a planar material and to a method for forming the container.

BACKGROUND OF THE INVENTION

Flowers are among the most often given and most widely appreciated gifts. Generally, flowers look best when presented as a floral arrangement in a vase. However, floral arrangements are expensive, and vases are bulky. Many gift givers thus settle for cellophane or tissue paper-wrapped flowers with a tie string, together with a plain note card. This is typically a leaky and unimpressive manner of presentation, albeit inexpensive. It would be preferable to present flowers with an attractive, convenient, and decorative vase that even has an appropriate theme for the occasion, yet is inexpensive.

In U.S. Pat. No. 4,917,240 (to Roberts, et al), a floral greeting card is disclosed which has an expandable base and a separate face card which attaches to the base. The base is capable of supporting a floral-preserving foam into which flowers are inserted. The base and face card have cooperating apertures in their sides through which the flowers can extend. The face card may have designs and greetings on it.

U.S. Pat. No. 2,396,010 (to Isenberg) discloses a novelty carton consisting of one sheet of material which folds into a package having a single, upwardly projecting, decorative element.

U.S. Pat. No. 3,224,660 (to Willis, et al) discloses a decorative carton in which there are decorative elements that form portions of the structure.

U.S. Pat. No. 4,896,819 (to Grossman) discloses a three-piece foldable decorative gift basket.

There is still a need for a vase formed from one sheet of material that has multiple decorative elements inbetween walls of the vase to be assembled, yet do not form part of the walls of the assembled vase. This would provide a greater variety of decorative shapes for a container formed of a single sheet of material.

SUMMARY OF THE INVENTION

The invention is a container, such as a vase, which has multiple decorative panels extending from walls of the container. The container is formed from a single substantially planar material, such as vinyl, two- or three-ply paper or paperboard, preferably die-cut and treated so as to be waterproof. In the container's disassembled state, the decorative panels are between adjacent walls of the container. When assembled, the decorative panels do not define part of the wall structure, but rather extend from the walls.

In one embodiment, the vase is substantially square in section and has two decorative panels extending diagonally from opposite corners of the square. In a second embodiment, decorative panels extend at 90° from opposite sides of a square vase. In a third embodiment, four decorative panels extend from a square vase.

In a fourth embodiment, which is similar to the third embodiment, decorative panels have patterns formed by recesses in their sides, in addition to decorative tops, yet the panels are still connected between adjacent walls in a single material. In this embodiment, the assembled vase is collapsible to a relatively planar form. In addition, the sheet of material has tacky surfaces (normally tacky, heat-activated, or otherwise) at appropriate positions to hold the vase together when folded, thus simplifying assembly.

In a fifth embodiment, decorative panels extend outward from a substantially cylindrical vase. Other embodiments include hexagonal and triangular sectional shapes for the assembled vase, each embodiment having multiple decorative panels extending from the walls of the vase.

In further embodiments, there is a foldable insert having a plastic liner heat-sealed to it, which insert and liner are friction-fit into the walls of the vase such that the liner provides water tightness. In a variation of this embodiment, the vase has no bottom.

BRIEF DESCRIPTION OF THE DRAWINGS

FIG. 5 is an unassembled, spread-out view of die-cut material for a vase in accordance with a third embodiment of the invention;

FIG. 6 is a top view of the vase assembled from the material of FIG. 5;

FIG. 7 is an unassembled, spread-out view of die-cut material for a vase in accordance with a fourth embodiment of the invention;

FIG. 8 is a top view of the vase assembled from the material of FIG. 7;

FIG. 9 is a front, slight perspective view of the assembled vase of FIG. 8;

DETAILED DESCRIPTION OF THE PREFERRED EMBODIMENTS

In the preferred embodiments, a single sheet of material, preferably die-cut and formed of a paperstock, vinyl, or other suitable plastic, folds into a container, such as a vase. Vinyl and other plastics are advantageous in that texture, such as ribbing or ridges, can readily be incorporated, and printing and graphics capability is enhanced as compared with paperstock.

The sheet contains walls, or sections of walls, for forming a container core, i.e., the vase structure, and multiple decorative panel sections interspersed between the walls or wall sections. The vase structure is preferably such that it will hold water, and thus the paperstock is coated with a waterproofing material. As one alternative to waterproofing, or in addition thereto, a plastic liner (alone or supported around an insertable structure) may be combined with the vase to achieve a watertight structure.

The vase, once assembled, has multiple decorative panels formed from mirror-image pairs of the decorative panel sections. The decorative panels extend outward from the vase walls.

It is most preferred that the walls and panels have printing, or other indicia, in addition to having decorative shapes. The printing preferably is performed on the paper stock prior to cutting. Then, the stock is cut by die-cutting, or the equivalent, to produce the decorative, shaped panel sections and any decorative shapes on the wall tops, and to provide appropriate folding creases as is well-known in the art. Alternatively, the material can be die-cut first, then imprinted.

The printing may be any suitable type, such as four-color printing, embossing, hot-stamping, and would preferably have a theme, such as get well, happy birthday, and special occasion greetings.

Once printed and cut, the material is treated to waterproof it by processes well-known in the art. Then, the material is folded to form the vase and decorative panels and is held together by glue, or other means, such as a bonding substance (or by means of poly or vinyl coatings which will bond together under heat) applied to the material after waterproofing, during the fabrication process. Preferably, the assembled vase is collapsible into a substantially planar shape for packaging, shipment, and storage, and then expandable for use.

Figure 1:
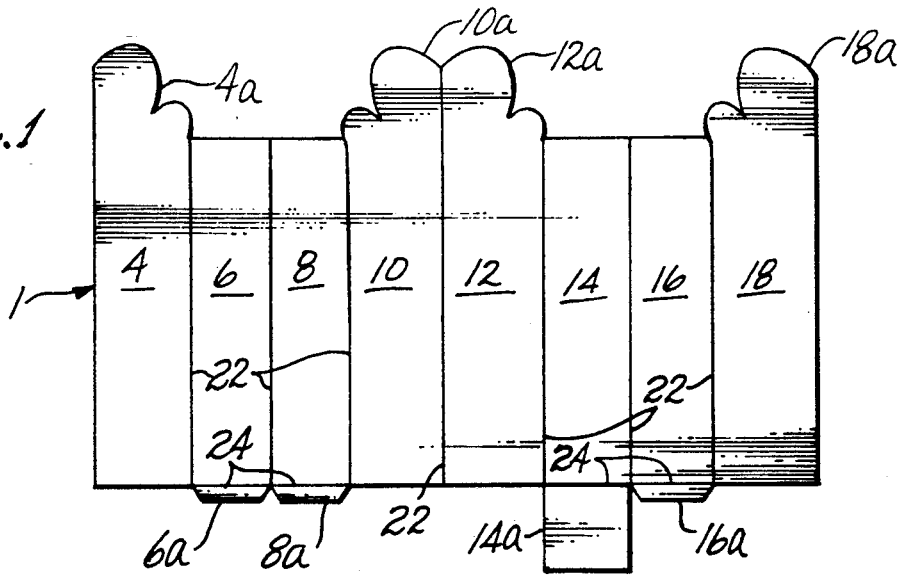
FIG. 1 is an unassembled, spread-out view of a die-cut material for a vase in accordance with a first embodiment of the invention.

FIG. 1 shows an unfolded view of a single die-cut sheet for forming a vase in accordance with a first embodiment of the invention. From left to right, looking at FIG. 1, there is a decorative panel section 4 with a decorative top 4a, a left side wall 6, a front wall 8, panel sections 10, 12 with mirror-image decorative tops 10a, 12a, a right side wall 14, a rear wall 16, and a panel section 18 with a decorative top 18a which is a mirror image of top 4a. Between each wall and panel section, there is a vertical folding crease 22. Walls 6, 8, 14, 16 each have bottom flaps 6a, 8a, 14a, 16a, defined by horizontal folding creases 24, respectively.

Figure 2:
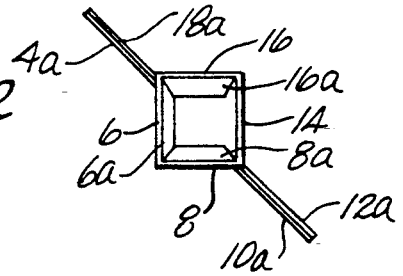
FIG. 2 is a top view of the vase assembled from the material of FIG. 1.

To form the vase, fold together pairs of decorative panel sections 4, 18 and 10, 12 so that they meet, and fold walls 6, 8 and 14, 16 at 90° angles, as shown in the top view of the assembled vase in FIG. 2. Thus, the four panel sections form two panels 4, 18 and 10, 12 which extend out diagonally from opposite corners of a square section vase core structure. The vase is held together by applying a waterproof glue (or using other sealing and fastening means) between panel sections 4, 18 and 10, 12. To complete the bottom of the vase, fold flaps 6a, 8a, 16a about creases 24 to 90° to walls 6, 8, 16, respectively. Then, fold square flap 14a, with glue applied between each of flaps 6a, 8a, 16a, and flap 14a. Alternatively, flap 14a is folded inward first, then the smaller flaps are folded.

Figure 3:
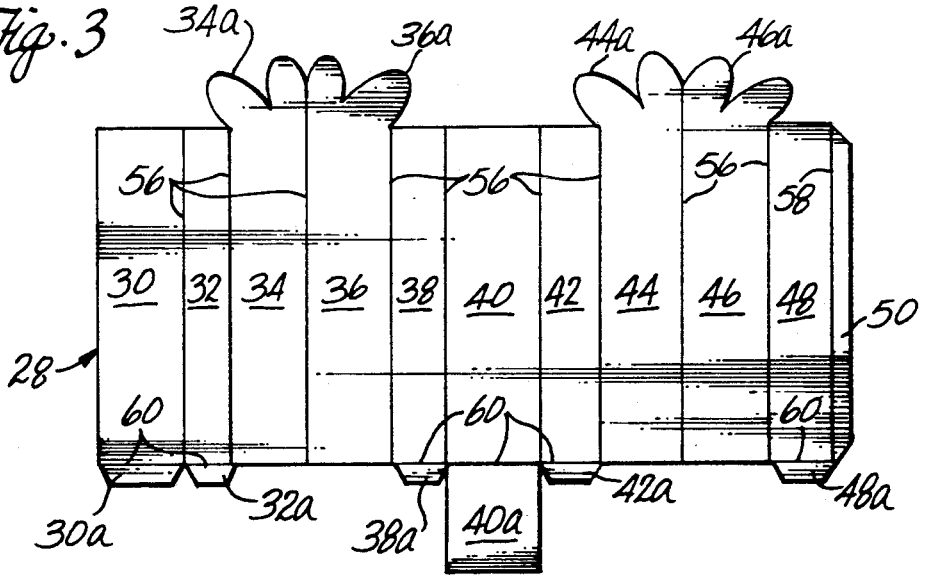
FIG. 3 is an unassembled, spread-out view of die-cut material for a vase in accordance with a second embodiment of the invention.

In a second embodiment of the invention, a plurality of decorative panels extend outward from opposing walls of a square sectioned vase core. FIG. 3 is an unfolded view of a sheet 28 of material for forming the vase. From left to right, there is a rear wall 30, a left wall portion 32, a panel section 34 with a decorative top 34a, a panel section 36 with a decorative top 36a which is a mirror image of top 34a, a left wall portion 38, a front wall 40, a right wall portion 42, panel sections 44, 46 with mirror-image decorative tops 44a, 46a, a right wall portion 48, and a rear flap 50. The walls and wall portions and decorative panel sections are separated by vertical folding creases 56. Horizontal folding creases 60 define flaps 32a, 38a, 42a, 48a, 30a, and 40a from wall portions 32, 38, 42, 48 and walls 30, 40, respectively.

Figure 4:
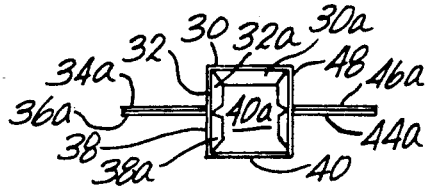
FIG. 4 is a top view of the vase assembled from the material of FIG. 3.

To form the vase as shown in the top view of FIG. 4, fold decorative panel sections 34, 36 together and fold panel sections 44, 46 together, applying glue as appropriate. Then, fold walls 30, 40 and wall portions 32, 38, 42, 48 to form four 90° walls of the vase, with the decorative panels extending outward. Flap 50 is shown folded inside and contacting (glued to) wall 30, but it could be folded outside the wall, as desired. To form the bottom of the vase, fold flaps 30a, 32a, 38a, 42a, 48a inward to 90° to the walls, then fold square flap 40a, applying glue therebetween. Alternatively, square flap 40a is folded to 90° first, then the other flaps are folded.

In a third embodiment of the invention, a sheet 64 of material is shown in its unfolded state in FIG. 5. It folds into a vase of square section with four decorative panels extending in substantially an H-shaped pattern, as shown in FIG. 6.

From left to right in FIG. 5, there is a panel section 68 with a decorative top 68a, a left side wall 70, two panel sections 72, 74 with decorative tops 72a, 74a which are mirror images, a front wall 76, two more panel sections 78, 80 with decorative tops 78a, 80a which are mirror images, a right side wall 82, two further panel sections 84, 86 with decorative tops 84a, 86a which are mirror images, a rear wall 88, and a last panel section 90 with decorative top 90a which is a mirror image of top 68a. Between the walls and panel sections, there are vertical folding creases 94, except that between front wall 76 and panel sections 74, 78 and between rear wall 88 and panel sections 86, 90, there is no need for a folding crease. Each wall 70, 76, 82, 88 has a flap 70a, 76a, 82a, 88a, respectively, defined by horizontal folding creases 96.

To form the vase, fold together adjacent decorative panel sections 72 and 74, 78 and 80, 84 and 86, and the outside sections 68 and 90 and glue them together, thus forming walls 70, 76, 82, 88 in a square. Then fold flaps 70*a*, 82*a*, 88*a*, followed by square flap 76*a*, applying glue between it and the other flaps. Alternatively, flap 76*a* is folded prior to the other flaps.

In a fourth embodiment of the invention, the vase is substantially cylindrical, or an inverted, slightly frustoconical shape, with two decorative panels extending outward therefrom. In FIG. 7, a sheet 99 of material has a first wall section 102, panel sections 104, 106 having mirror-image decorative tops 104*a*, 106*a*, a second wall section 108, two more panel sections 110, 112 having mirror-image decorative tops 110*a*, 112*a*, and a third wall section 114. First wall section 102 has a lower flap 102*a*. Second wall section 108 has flaps 108*a*, 108*b* and substantially circular flap 108*c*. Third wall section 114 has a lower flap 114*a* and a side flap 114*b*.

To form an assembled vase as shown in the top view of FIG. 8 and front elevational, slight perspective view of FIG. 9, fold and glue together the adjacent panel sections 104 and 106, 110 and 112, then glue flap 114*b* to the inside (or, alternatively, on the outside) of first wall 102.

The bottom of the vase is formed by folding flaps 102*a*, 108*a*, 108*b*, and 114*a* inward, followed by substantially circular flap 108*c*, and applying glue between it and the other flaps. Alternatively, fold flap 108*c* first, then fold the other flaps.

Preferably, the decorative panels are at 180° from each other, and the first and third wall sections are quarter cylinders, while the second wall section is a one-half cylinder.

In a fifth embodiment of the invention, the vase is similar to the third embodiment, but each decorative panel has decorative sides, as well as a decorative top. Moreover, in this embodiment, the vase, once assembled, is collapsible to a relatively flat form. Of course, the other embodiments could be constructed so as to collapse into a flat form, too.

Figure 10:
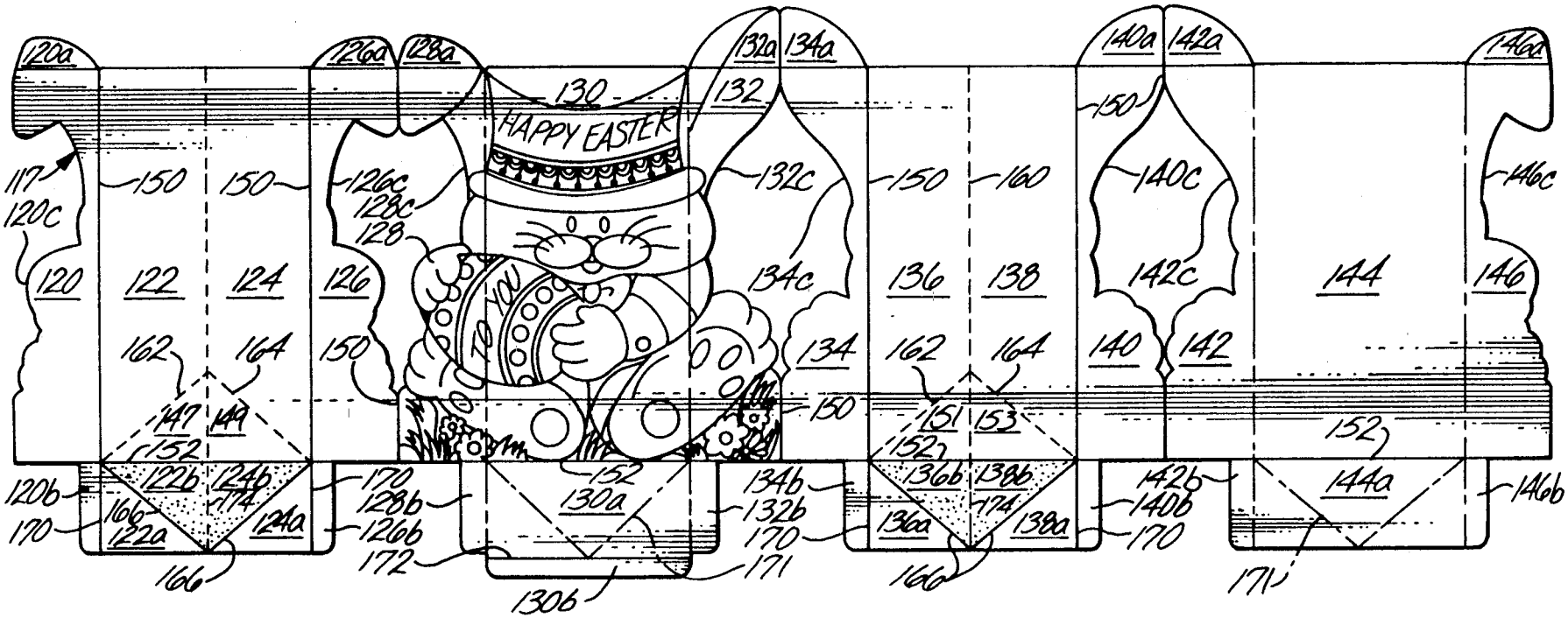
FIG. 10 is an unassembled, spread-out view of die-cut material for a vase in accordance with a fifth embodiment of the invention.

FIG. 10 shows a sheet 117 of material which, from left to right, has a panel section 120 with a decorative top 120*a* and side 120*c*, left wall sections 122, 124, adjacent mirror-image panel sections 126, 128 with decorative tops 126*a*, 128*a* and sides 126*c*, 128*c*, a front wall 130, adjacent mirror-image panel sections 132, 134 having decorative tops 132*a*, 134*a* and sides 132*c*, 134*c*, right wall sections 136, 138, adjacent mirror-image panel sections 140, 142 having decorative tops 140*a*, 142*a* and sides 140*c* and 142*c*, rear wall 144, and panel section 146 having decorative top 146*a* and side 146*c*, which panel section is a mirror image of panel section 120. Sheet 117 has four tabs 117*a*–117*d* separated by horizontal folding creases 152. The tabs 117*a*–117*b* and wall sections 122, 124 and 136, 138 have additional creases discussed below.

Front wall 130 and panel sections 128, 132 have a picture, e.g., a rabbit with an easter egg, and the rear wall 144 and sections 142, 146 can have a similar picture.

Figure 11:
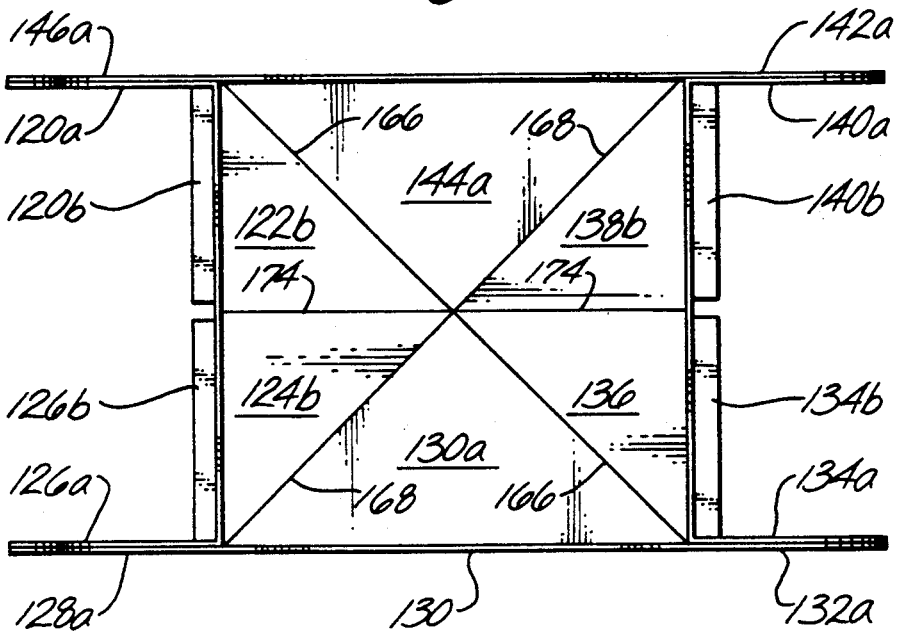
FIG. 11 is a top view of the vase assembled from the material of FIG. 10.
Figure 12:
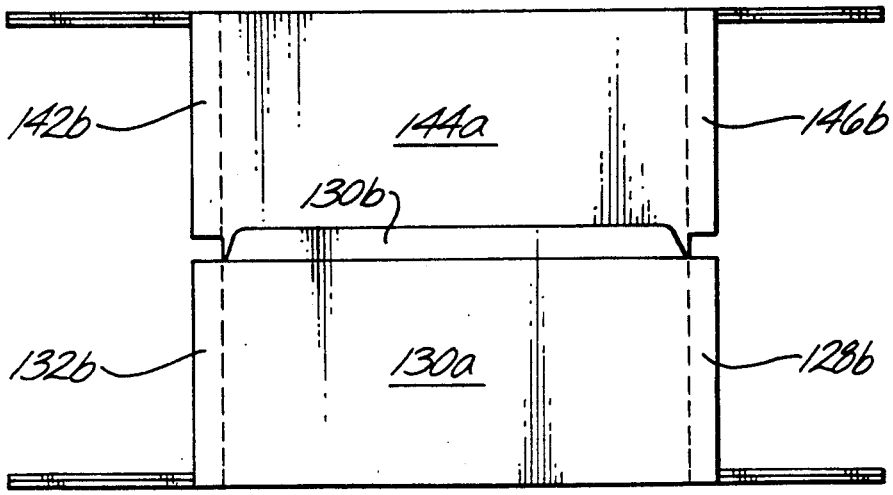
FIG. 12 is a bottom view of the vase assembled from the material of FIG. 10.
Figure 13:
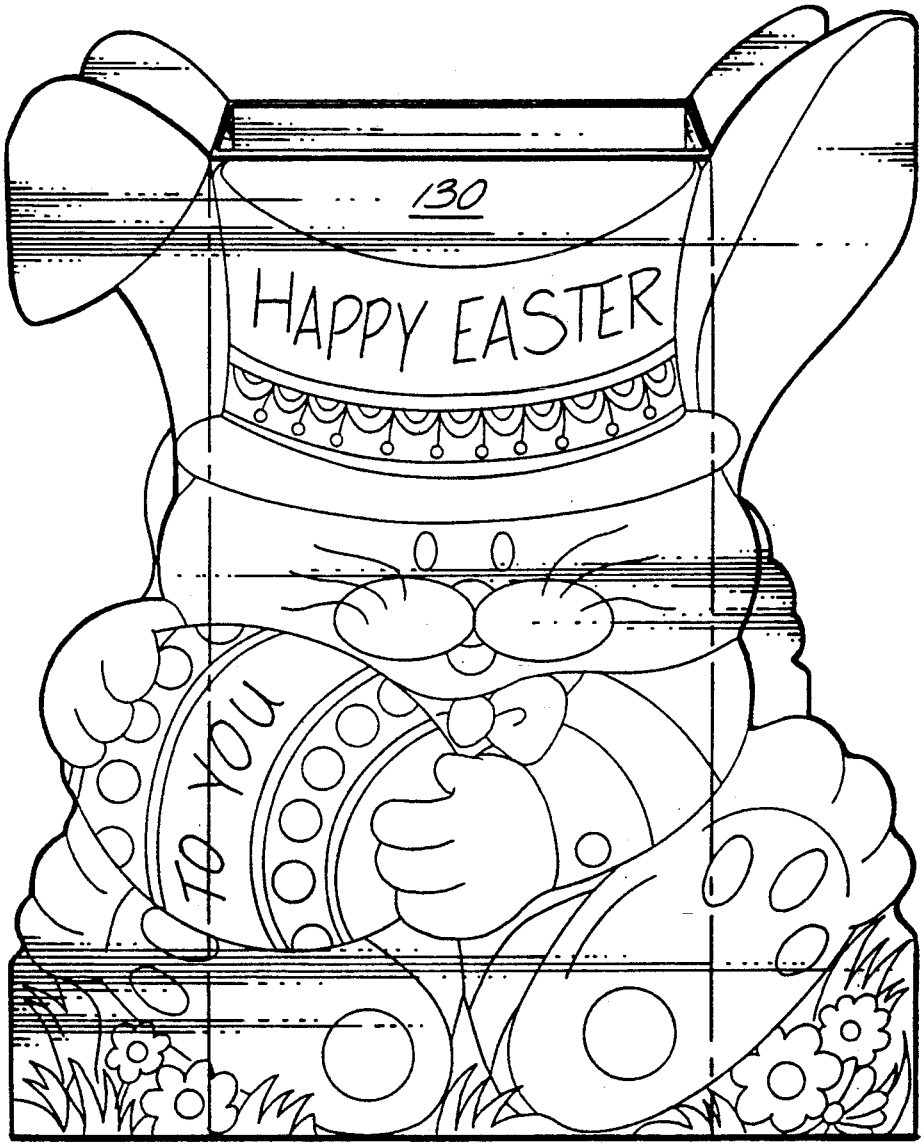
FIG. 13 is a front, slight perspective view of the assembled vase of FIG. 12.

To form the assembled vase shown in the bottom, top, and front elevational views of FIGS. 11, 12, and 13, respectively, there are several folding steps. First, using vertical creases 150, fold the back of panel sections 126, 134, 140, and 120 to the backs of panel sections 128, 132, 142, 146, respectively, applying glue.

Second, using diagonal creases 166, fold and glue the front of triangular tabs 122*a*, 124*a* (formed by creases 166 and 170) to meet the front of tabs 122*b*, 124*b*, respectively, and do the same with triangular tabs 136*a*, 138*a* so as to meet tabs 136*b*, 138*b*. At the same time, fold each entire tab 117*a*, 117*c* about creases 152 inward to approach 90° to the walls of the vase.

Third, using vertical creases 170, fold the backs of tabs 120*b*, 126*b*, 134*b*, and 140*b* to the backs of tabs 146*b*, 128*b*, 132*b*, 142*b*, respectively, applying glue, and also fold the back of flaps 130*a* and 144*a* to the backs of triangles 124*a* and 136*a*, 122*a* and 138*a*, respectively, applying glue. Also, position tab 130*b* so as to contact and overlap flap 144*a*, and apply glue. Alternatively, tab 130*b* could be folded inside of flap 144*a*.

At this point, if walls 122, 124 and 136, 138 tend to collapse on vertical creases 160, 174, push outward, on or near, triangles 122*c*, 124*c*, and 136*c*, 138*c* until the vase "locks" in an open position.

Figure 14:
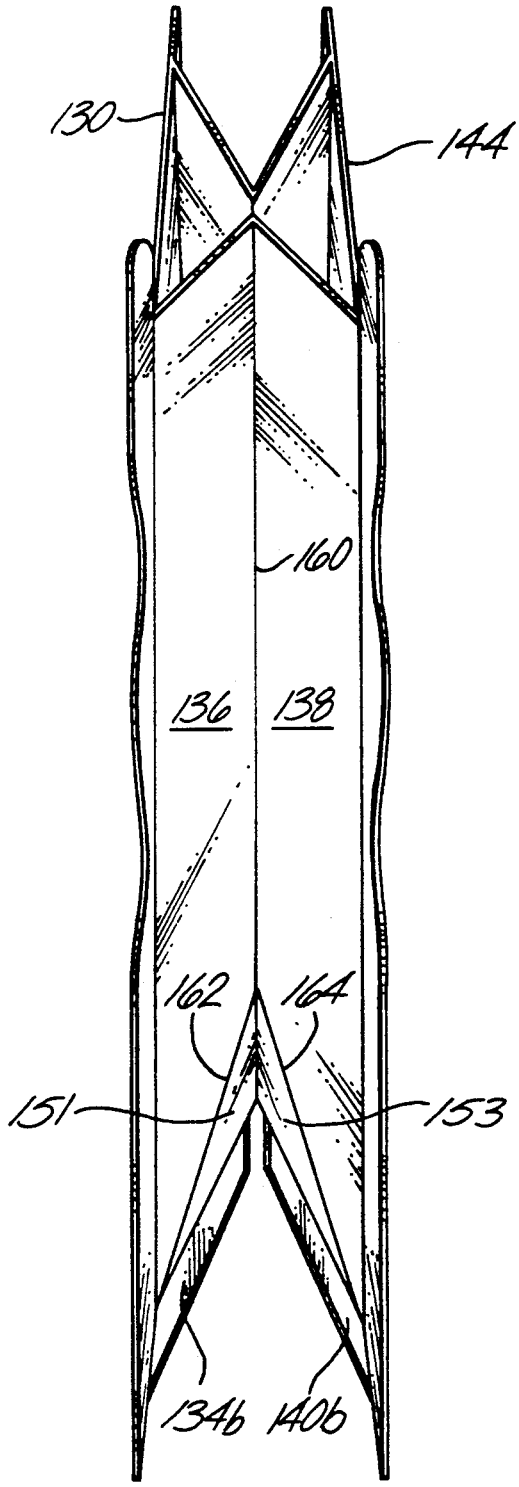
FIG. 14 is a side, slight perspective view of an assembled, but partially folded vase of FIG. 13.

In accordance with another aspect of the invention, the assembled vase is collapsible into a relatively flat shape, as shown in FIG. 14. (In FIG. 10, creases that are used solely for collapsing the vase are shown as dashed lines.) This is accomplished by folding on vertical creases 160, 174, diagonal creases 166, and horizontal crease 172. If it is difficult to start the collapsing process, push inward on triangles 122*c*, 124*c*, 136*c*, 138*c*.

In accordance with a further aspect of the invention, a means to glue, or otherwise hold tabs and decorative panels together, is integrally applied to the die-cut sheet 117 at appropriate places by putting a tacky substance in these places. These places are, for example, at glue 175 on the front surfaces of triangles 122*b*, 124*b*, 136*b*, 138*b* and glue (not shown) on the rear surfaces of decorative panels 120, 126, 134, 140 and tab 130*b*, and tabs 120*b*, 126*b*, 134*b*, 140*b*, and in triangular shapes on the backs of flaps 130*a* (including portions 128*b*, 132*b*), 144*a* (not including portions 142*b*, 146*b*) in position to meet the rear of triangles 124*a*, 136*a* and 122*a*, 138*a*, respectively. This tacky material can be covered with a plastic sheet for storage. Remove the sheet during assembly when "gluing" is required.

Figure 15:
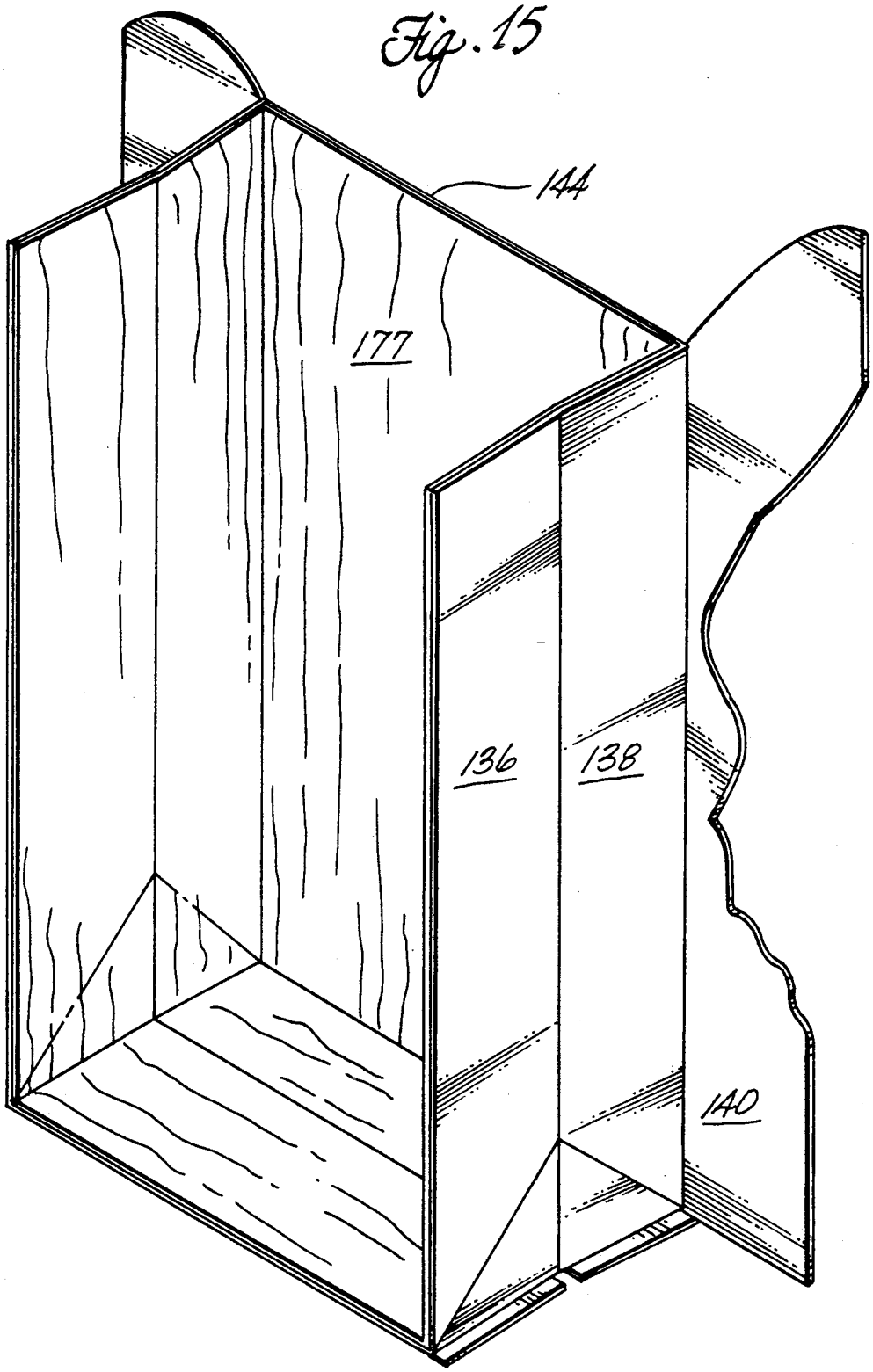
FIG. 15 is a cutaway, perspective partial view of the inside of the vase of FIG. 13, including a watertight liner.

In accordance with an aspect of the invention mentioned above, and as shown in FIG. 15, which is a cutaway, perspective, partial view of the inside of the assembled vase of FIG. 13, a plastic liner 177 has been heat-sealed (preferably, just around its top) to the walls and covers the entire, or substantially entire, inner surface of the container core. This eliminates the need for a water-resistant form of glue, as well as enhancing the watertight quality of the vase. The liner can be used in any embodiment. For example, in a later embodiment, the liner is supported on a structure which is insertable into the container core.

Figure 16:
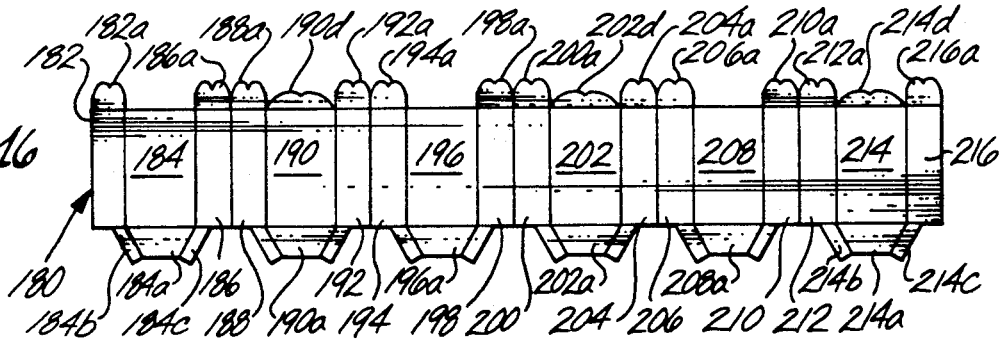
FIG. 16 is an unassembled, spread-out view of die-cut material for a vase in accordance with a sixth embodiment of the invention.

In a sixth embodiment of the invention, the vase is hexagonal with one decorative panel extending from each corner. FIG. 16 shows a sheet 180 of die-cut material having six walls 184, 190, 196, 202, 208, and 214, with pairs of mirror-image decorative panel sections 186 and 188, 192 and 194, 198 and 200, 204 and 206, and 210 and 212, interspersed therebetween. One end of the die-cut material also has a decorative panel section 182, and the other end has a decorative panel section 216 which is a mirror image of section 182. Three of the walls 190, 202, 214 have decorative top portions 190*d*, 202*d*, 214*d*, respectively, and all of the panel sections have decorative tops 182*a*, 186*a*, 188*a*, 192*a*, 194*a*, 198*a*, 200*a*, 204*a*, 206*a*, 210*a*, 212*a*, and 216*a*. The walls have respective tabs 184*a*, 190*a*, 196*a*, 202*a*, 208*a*, and 214*a*.

Figure 17:
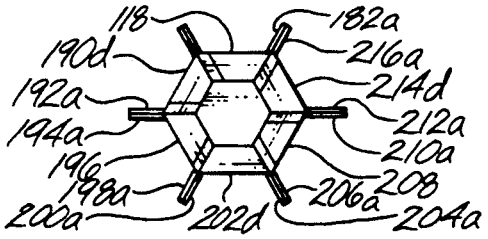
FIG. 17 is a top view of the vase assembled from the material of FIG. 16.

This sheet of material folds into a hexagonal cross sectional shape, as shown in the top view of FIG. 17. This shape is achieved by folding adjacent decorative panel sections together to form decorative panels, then folding the walls into the hexagonal shape and having the end two decorative panel sections meet to form a last decorative panel, applying glue between the panel sections. The bottom tabs are then folded to form the bottom of the container, with glue applied as appropriate.

Figure 18:
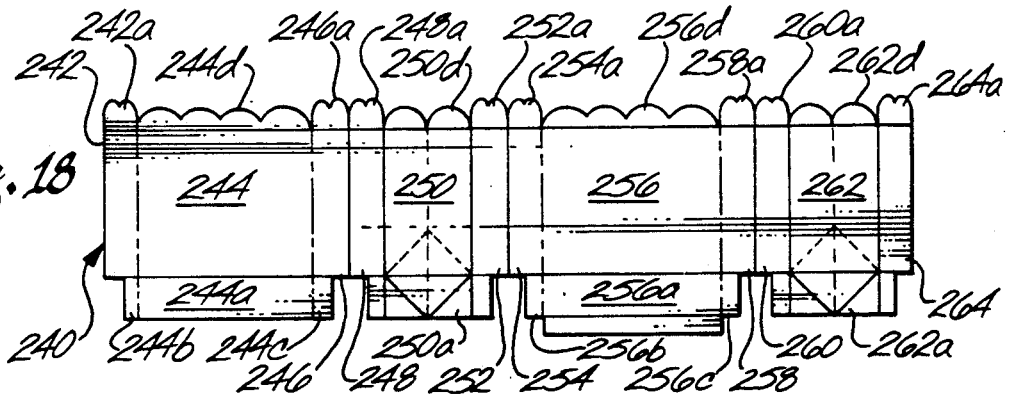
FIG. 18 is an unassembled, spread-out view of die-cut material for a vase in accordance with a seventh embodiment of the invention.
Figure 19:
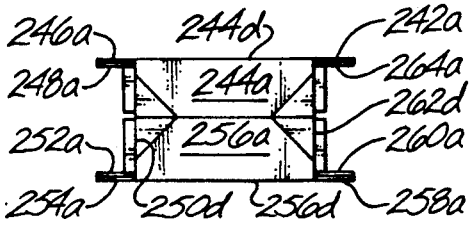
FIG. 19 is a top view of the vase assembled from the material of FIG. 18.

A seventh embodiment, in which the vase is rectangular in section, is shown in FIGS. 18 and 19. FIG. 18 shows a single sheet 240 of material having a decorative panel section 242, a wall 244, decorative panel sections 246, 248, followed by a wall 250, decorative panel sections 252, 254, a wall 256, decorative panel sections 258, 260, a wall 262, and a last decorative panel section 264. The panel sections have decorative tops 242*a*, 246*a*, 248*a*, 252*a*, 254*a*, 258*a*, 260*a*, and 264*a*. The walls also have decorative tops 244*d*, 250*d*, 256*d*, 262*d*. The walls 244 and 256 are longer than the walls 250 and 262 such that, when folded, the core has a rectangular cross section, as shown in the top view of FIG. 19. The walls have bottom tabs 244*a*, 250*a*, 256*a*, and 262*a*.

To form the rectangular container, adjacent decorative panel sections are folded together and glued, the walls are folded to 90° from each other, and the outer two decorative panel sections 242, 264 are glued together. The tabs 250*a*, 262*a* are then folded inward, and the larger tabs 244*a* and 256*a* are then folded below those (or vice versa), gluing where appropriate.

Figure 20:
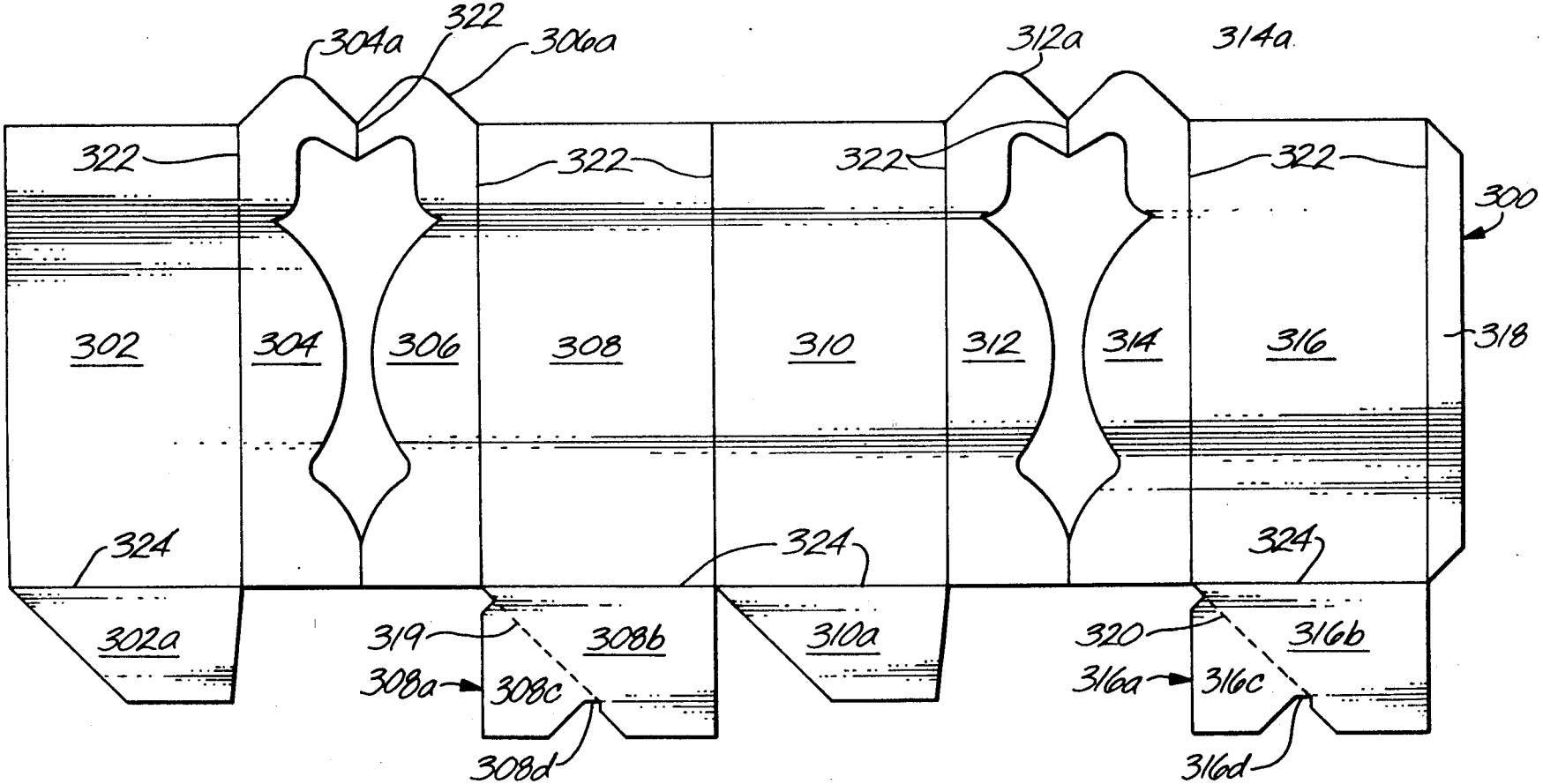
FIG. 20 is an unassembled, spread-out view of die-cut material for a vase in accordance with a seventh embodiment of the invention.

An eighth embodiment, having a "fold-up" bottom, is shown in FIG. 20. A sheet 300 of material has a wall 302, a pair of mirror-image decorative panel sections 304, 306, two more walls 308, 310, another pair of mirror-image decorative panel sections 312, 314, a wall 316, and a tab 318. The panel sections have decorative tops 304*a*, 306*a*, 312*a*, 314*a*. The walls may also have decorative tops, similar to FIGS. 16 and 18. The walls have bottom panels 302*a*, 308*a*, 310*a*, 316*a*, the panels 308*a*, 316*a* each having two sections 308*b*, 308*c* and 316*b*, 316*c* which are defined by folding creases 319, 320, respectively. The walls and decorative panel sections are all separated by vertical folding creases 322, and the bottom panels are defined by horizontal folding creases 324.

Figure 21:
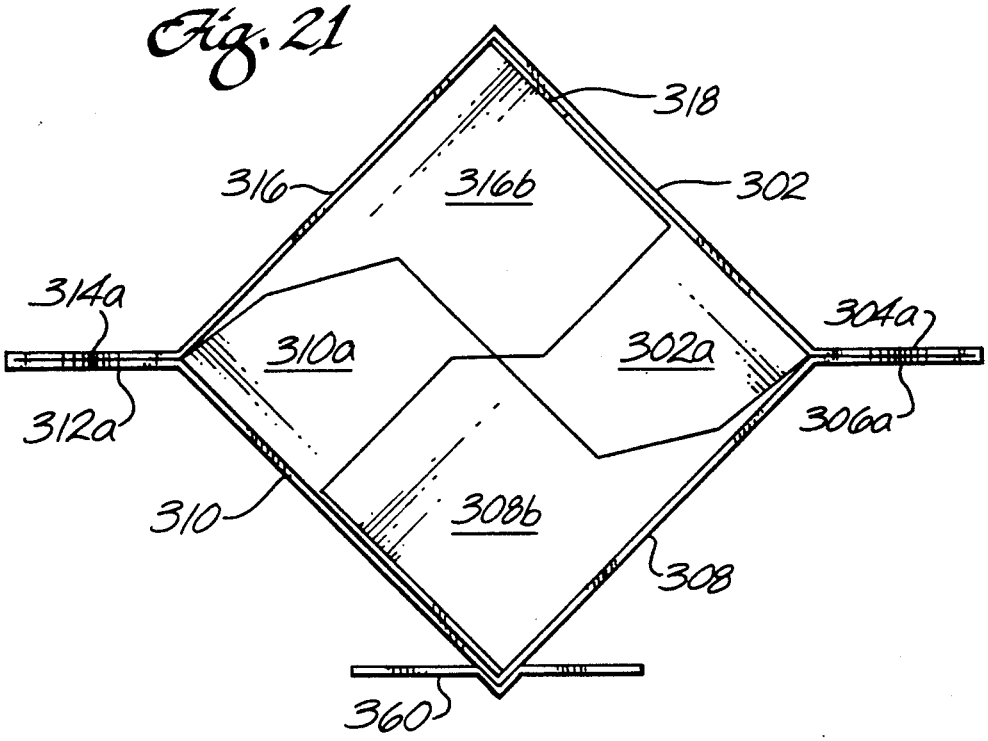
FIG. 21 is a top view of the vase assembled from the material of FIG. 20.
Figure 22:
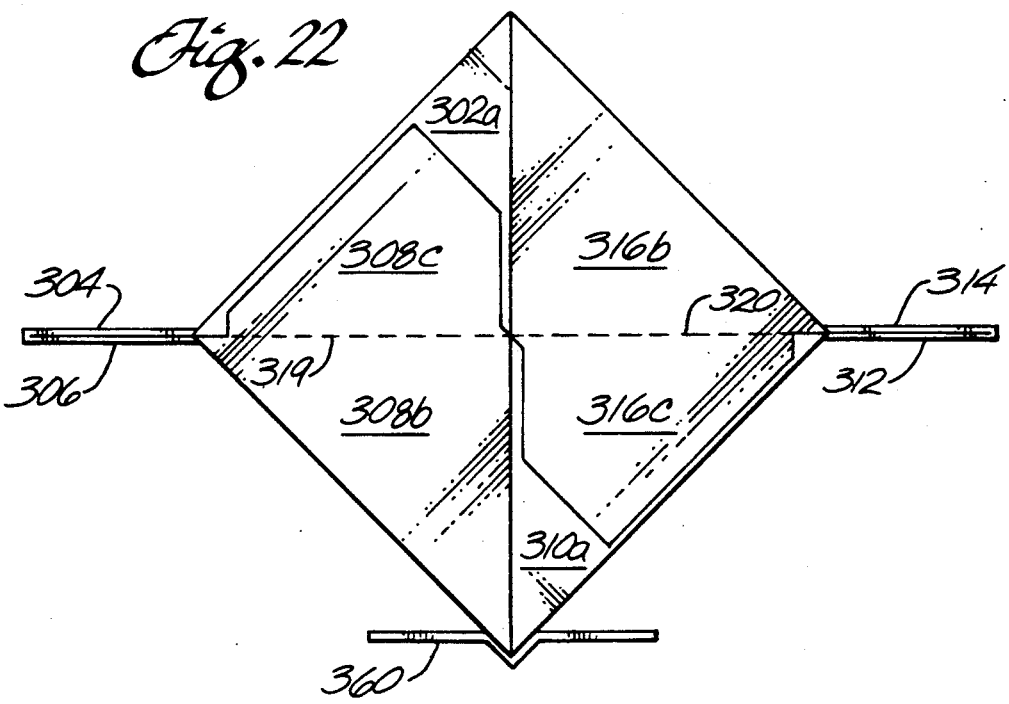
FIG. 22 is a bottom view of the vase of FIG. 21.

Top and bottom views of the assembled vase are shown in FIGS. 21 and 22. To assemble the vase, the backs of the decorative panel sections in each pair are folded and glued together to form two decorative panels, then the walls are folded into a square section, and tab 318 is glued to the inside (or outside) of wall 302. Bottom panels 302*a*, 310*a* are then folded inward. The back of section 308*c* is glued to panel 302*a*, and the back of section 316*c* is glued to panel 310*a*. Notches 308*d*, 316*d* are then interlocked.

The bottom structure is such that it will fold inward and upward when the assembled vase is folded to a substantially planar shape, with the decorative panels extended to each side. When the panels are pressed toward each other, the vase expands, and the bottom structure moves downward and automatically interlocks again at notches 308*d*, 316*d*. This structure can be used with the other embodiments, too.

Since the bottom is not completely glued together, a watertight container is preferably achieved by a plastic liner mounted around an insertable support. This structure may be used with all embodiments of the invention, and is shown in FIG. 23 for this embodiment.

Liner 340 is heat-sealed to the outside of a support 350. The support has a sectional shape which is the same as that of the container core formed by the walls, but slightly smaller. The support is preferably of the same or similar material as the sheet 300 and is preferably waterproofed by poly-coating or the like. The support is formed by walls 351, 352, 353, 354 and a tab 355 for gluing to the inside of wall 351. There is no bottom. The bag-shaped liner 340 is heat-sealed to the walls on the outside of the support, preferably near the top of the support, and preferably adjacent the liner's top 340*a* to a height shown by line 340*b*. The rest of the liner is preferably loose, though more can be heat-sealed.

Figure 24:
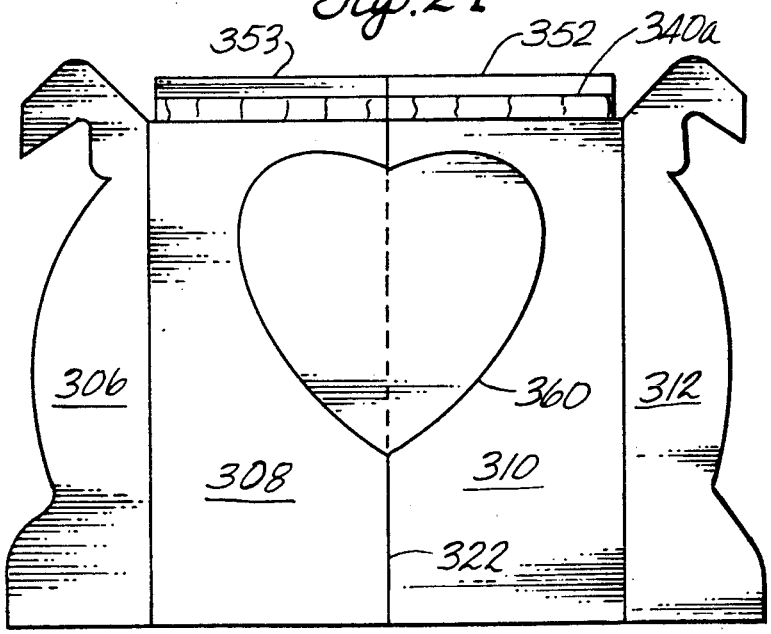
FIG. 24 is a view of the vase and insert of FIG. 23 folded substantially flat.

The support 350, including the liner 340, is friction-fit inside the container core. The support has slots 357, 358 formed by cooperating cuts in the bottom corners of walls 351–354. These slots line up with the decorative panels to facilitate folding the vase to a flat position, which is shown in FIG. 24. The height of the support 350 is preferably less than that of the vase walls 302, 308, 310, 316, so that the bottom panels 302*a*, 308*a*, 310*a*, 316*a*, when folded inward, have some clearance without the insert extending too far out of the vase. However, the insert preferably extends outward a bit when storing the vase in its flat position to accommodate the bottom flaps and also so that when the vase is opened, the insert can be pressed downward into the vase until meeting the bottom to help hold it open. The insert will thus help hold the bottom in a planar orientation. The inner walls of the insert may be provided with a line or other indication marking the maximum desirable water level.

Figure 23:
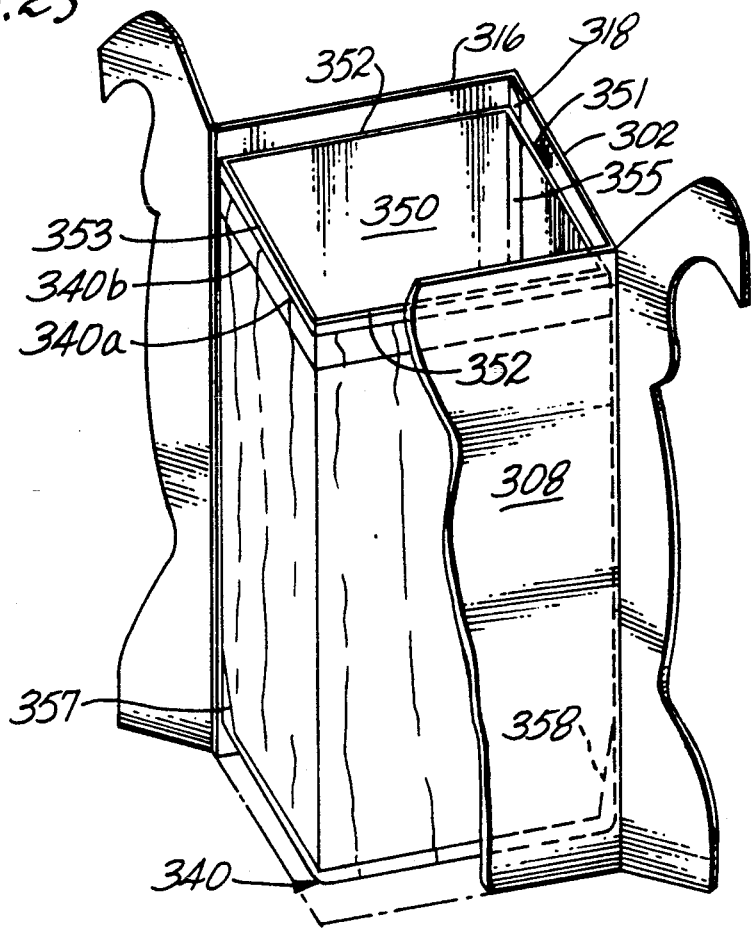
FIG. 23 is a cutaway, perspective, partial view of the inside of the vase of FIG. 21, including an insert and a watertight lining and omitting the vase bottom.

It is noted that in FIG. 23, no bottom is shown for the vase. This is because the vase need not have a bottom where the plastic liner is used.

The vase is further decorated by fixing, such as by gluing, a decorative die-cut element, e.g., a heart, to it. In FIGS. 21, 22, and 24, a heart-shaped element 360 is glued to the container core at the crease 322 between walls 308, 310.

There are many other variations that will be apparent to one of ordinary skill in the art. For example, many other configurations are possible, such as a triangular configuration and a circular configuration. Therefore, the appended claims define the invention, rather than the invention being limited to the disclosed embodiments.

What is claimed is:

1. A decorative container comprising:

a container core comprising a plurality of wall sections, the core having an open top; and at least one decorative panel extending outward from the container core without forming a part of the container core, the decorative panel being formed by a pair of decorative panel sections having non-square edges, wherein the wall sections and decorative panel sections are unitarily formed in a sheet of material, two of the wall sections are unitarily connected to the pair of decorative panel sections, respectively, with the pair of panel sections therebetween, the pair of decorative panel sections being folded together to form the decorative panel, such that the two wall sections are disposed adjacent one another in the container core, wherein decoratively shaped edges are formed in exterior edges of the pair of decorative panel sections remote from the container core.

2. The container of claim 1, wherein the container core has one of a hexagonal, circular, and rectangular cross sectional shape.

3. The container of claim 1, wherein the container core has inner surfaces, and a watertight liner is attached to the inner surfaces.

4. The container of claim 1, wherein the decorative panel sections have decoratively shaped top edges, and wherein the decorative panel sections each have decoratively shaped side edges formed by cutouts in the sheet of material.

5. The container of claim 1, wherein the first and second pairs of decorative panel sections each have mirror-image decoratively nonsquare-shaped side edges.

6. The container of claim 1, further comprising means for defining a bottom to the container core.

7. The container of claim 6, wherein the means for defining a bottom is unitarily formed in the sheet of material.

8. The container of claim 6, wherein the means for defining a bottom comprises a watertight liner and a support for the liner, and the liner and support are friction-fit in the container core.

9. The container of claim 8, wherein the container is collapsible to a substantially planar form.

10. The container of claim 7, further comprising a watertight liner and a support for the liner, and the liner and support are friction-fit in the container.

11. A decorative container formed from a unitary sheet of material comprising a plurality of walls formed by wall sections and a plurality of decorative panel sections having nonsquare edges, the wall sections cooperating to form a container core of a predetermined cross sectional shape, with an open top; and wherein at least two of the wall sections are separated by a first pair of the decorative panel sections, such that the first pair of decorative panel sections are folded together to form a first decorative panel extending outwardly from the walls of the container core, and such that the two wall sections are adjacent one another in the container core, wherein a second decorative panel extends outwardly from the walls and is formed by a second pair of the decorative panel sections, wherein decoratively shaped edges are formed in exterior edges of at least the first pair of decorative panel sections remote from the container core.

12. The container of claim 11, wherein the second pair of decorative panel sections are provided between and linking two other of the wall sections, and are folded together to form the second decorative panel, such that the two wall sections linked by the second pair of decorative panel sections are disposed adjacent one another in the container core, and wherein the second pair of decorative panel sections have decoratively shaped exterior edges remote from the container core.

13. The container of claim 11, wherein the sheet of material has two opposite ends, and one of the second pair of decorative panel sections is connected to a wall section at one end of the sheet of material, and the other of the second pair of decortive panel sections is connected to a wall section at an opposite end of the sheet of material, and the one and the other of the second pair of decorative panel sections are positioned against each other to form the second decorative panel, such that the wall sections at the opposite ends of the sheet of material are disposed adjacent one another in the container core.

14. The container of claim 11, wherein there are four walls, at least two straight walls each being formed by a respective pair of wall sections, each pair of wall sections having the first pair and a second pair of decorative panel sections, respectively, connected thereto and therebetween such that the first and second pairs of decorative panel sections, when folded together, form the first and second decorative panels, respectively, so that each of the panels extend outward from the container core from a position where each pair of wall sections meet.

15. The container of claim 11, wherein the first and second pairs of decorative panel sections each have mirror-image decoratively nonsquare-shaped external edges.

16. The container of claim 11, wherein the first and second pairs of decorative panels extend from intermediate portions of opposite walls of the container core.

17. The container of claim 11, further comprising means for defining a bottom to the container core.

18. The container of claim 17, wherein the means for defining a bottom is unitary with the sheet of material, which comprises bottom sections connected to the wall sections, and further creases such that the bottom sections fold together to form the bottom.

19. The container of claim 17, wherein the means for defining a bottom comprises a watertight liner and a support for the liner, and wherein the liner and support are friction-fit in the container core.

20. The container of claim 18, further comprising a watertight liner and a support for the liner, and the liner and support are friction-fit in the container.

21. A method of forming a decorative container comprising a container core and at least first and second decorative panels extending from the container core, the method comprising the steps of:

cutting a unitary sheet of material and preparing the material so as to form side-by-side serially connected wall sections and first and second pairs of decorative panel sections, wherein decoratively shaped edges are formed in the exterior edges of the first pair of decorative panel sections remote from the container core, wherein at least the first pair of decorative panel sections has nonsquare edges is connected side-by-side between two wall sections; and folding the sheet of material such that the wall sections form walls of the container core, and the first and second pairs of the decorative panel sections fold together to form the first and second decorative panels, respectively, which extend outwardly from the walls of the container core.

22. The method of claim 21, further comprising the steps of fixing a watertight liner to a support and friction-fitting the support and liner inside the container core.

23. The method of claim 21, further comprising a step of collapsing the container into a substantially planar orientation.

24. The method of claim 21, wherein in the step of cutting and creasing, the wall sections are formed with tabs extending therefrom for forming a bottom of the container core, and in the step of folding, the tabs are folded to form a bottom of the container core.

25. The method of claim 24, further comprising the steps of fixing a watertight liner to a support and friction-fitting the support and liner inside the container core, wherein the tabs are foldable into the container core.

26. A decorative container comprising:

a container core comprising a plurality of wall sections, the core having an open top and the container core having means for providing watertightness; and first and second decorative panels extending outwardly from the container core without forming a part of the container core and formed by first and second pairs of decorative panel sections having nonsquare edges, respectively, wherein the wall sections and decorative panel sections are formed side-by-side in a unitary sheet of material, two of the wall sections are linked by the first pair of decorative panel sections, the first pair of decorative panel sections being folded together to form the first decorative panel, such that the two wall sections are disposed adjacent one another in the container core, whereby gift items and liquid may be placed in and supported in the container.

27. The container of claim 26, wherein the means for providing watertightness comprises a watertight liner and a support for the liner, and the liner and support are friction-fit in the container core.

28. The container of claim 26, wherein the first and second pairs of decorative panel sections each have mirror-image decoratively nonsquare-shaped external edges.

29. The container of claim 26, wherein the second pair of decorative panel sections are provided between and linking two other of the wall sections, and are folded together to form the second decorative panel, such that the two wall sections linked by the second pair of decorative panel sections are disposed adjacent one another in the container core, and wherein the second pair of decorative panel sections have decoratively shaped exterior edges remote from the container core.

* * * * *

UNITED STATES PATENT AND TRADEMARK OFFICE

CERTIFICATE OF CORRECTION

PATENT NO. : 5,137,207

DATED : August 11, 1992

INVENTOR(S) : Christine A. McAdam

It is certified that error appears in the above-identified patent and that said Letters Patent is hereby corrected as shown below:

On title page, item

[56] References Cited, U.S. PATENT DOCUMENTS, add class and subclass as follows:

| | | | |
|---|---|---|---|
| 3,224,660 | 12/1965 | Willis et al | 229/8 |
| 4,084,015 | 5/1978 | Patterson | 428/9 |
| 4,179,060 | 12/1979 | Meyers | 229/8 |
| 4,201,331 | 5/1980 | Austin | 229/39 |
| 4,418,497 | 12/1983 | Mastriano | 47/67 |
| 4,784,314 | 11/1988 | Penick | 229/8 |
| 4,840,275 | 6/1989 | Faiola et al | 206/423 |
| 4,887,709 | 12/1989 | Shimamine | 206/45 |
| 4,896,819 | 1/1990 | Grossman | 229/8 |
| 4,917,240 | 4/1990 | Roberts et al | 206/232 |

In the Claims

Column 10, line 46 before "nonsquare" change "has" to -- having --.

Signed and Sealed this

Fifth Day of October, 1993

Bruce Lehman

*Attest:*

BRUCE LEHMAN

*Attesting Officer*

*Commissioner of Patents and Trademarks*